United States Patent [19]

Fogarollo

[11] 4,085,629

[45] Apr. 25, 1978

[54] ELECTRIC WINDOW REGULATOR FOR MOTOR VEHICLES WITH MEANS FOR MANUAL EMERGENCY OPERATION

[75] Inventor: Pier Paolo Fogarollo, Chiavari (Genoa), Italy

[73] Assignee: LAMES Societa per Azioni, Chiavari (Genoa), Italy

[21] Appl. No.: 762,369

[22] Filed: Jan. 25, 1977

[51] Int. Cl.[2] ..... G05G 1/08; E05F 15/00

[52] U.S. Cl. ..... 74/625; 49/139; 49/140; 74/506

[58] Field of Search ..... 74/625, 506; 49/139, 49/140, 502

[56] References Cited

U.S. PATENT DOCUMENTS

| | | | |
|---|---|---|---|
| 2,524,714 | 10/1950 | Rappl | 74/625 |
| 3,203,690 | 8/1965 | Werner | 74/625 X |
| 3,515,250 | 6/1970 | Cantalupo | 74/625 X |
| 3,711,994 | 1/1973 | Ulbrich et al. | 74/625 X |
| 3,791,071 | 2/1974 | Niklaus | 74/625 |

*Primary Examiner*—Leonard H. Gerin

*Attorney, Agent, or Firm*—Sughrue, Rothwell, Mion, Zinn and Macpeak

[57] ABSTRACT

An electric window regulator for motor vehicles is provided with a handle which can be coupled to the window winding drum to effect manual operation of the window in an emergency, the handle having a portion which screws into the hub of the drum to displace a spring loaded splined coupling member and disengage the winding drum from the electric motor reduction gear drive, thereby permitting manual operation of the drum by the handle.

3 Claims, 4 Drawing Figures

ELECTRIC WINDOW REGULATOR FOR MOTOR VEHICLES WITH MEANS FOR MANUAL EMERGENCY OPERATION

The present invention relates to electric window regulators for motor vehicles, of the kind comprising a grooved drum upon which there is wound a cable which controls the window, the drum being driven by an electric motor through a reduction gear.

Electric window regulators, being more complicated and delicate than those which are manually operated, have the disadvantage of being prone to more frequent failure, since they are liable to the sort of failures which can occur in any electrical installation. Upon failure of the electrical circuit of an electric window regulator the window is effectively locked in its existing position. It would be desirable for the user to be able to operate the window control mechanism manually in the event of such failure in order to place the window into the most convenient position.

To this end, some electric window regulators are fitted with devices enabling the windows to be operated manually in emergency in the event of failure. Generally such devices consist of an emergency handle for application to the window control mechanism so as to act on suitably arranged auxiliary members and which allow the drum to be driven by the said handle. For ease of construction the emergency handle usually acts of the shaft of the electric motor, between the motor and the reduction gear so that a number of turns of the handle are required to cause the window to make its usual movement. Such emergency devices also have the disadvantage of increasing the bulk of the window regulator, as well as increasing its cost.

The object of the present invention is to eliminate the aforesaid disadvantages by providing an electric window regulator having means, of simple construction and of small bulk, including an auxiliary handle, which allows manual operation of a window in emergency and which requires for such manual operation a small number of turns of the auxiliary handle.

According to the present invention there is provided an electric window regulator for motor vehicles, comprising a grooved drum upon which is wound a window operating cable, an electric motor drivingly connected to the drum through a reduction gear, the driven member of the reduction gear being disposed alongside the grooved drum, a coupling for connecting the drum torsionally to the said driven member, the said coupling having an axially movable member, loaded by resilient means so as normally to couple the driven member and the drum together, and an auxiliary handle for effecting manual emergency operation of the regulator, said handle being adapted to fit on to an outer end portion of the hub of the drum and having a threaded shank which is adapted to be screwed into the said hub to displace the movable member of the coupling axially until it ceases to couple together the drum and the driven member of the reduction gear, thereby making possible manual operation of the drum by means of the said auxiliary handle.

The invention will be further understood from the following detailed description, given by way of non-limiting example, with reference to the attached drawings, in which.

Figure 1:
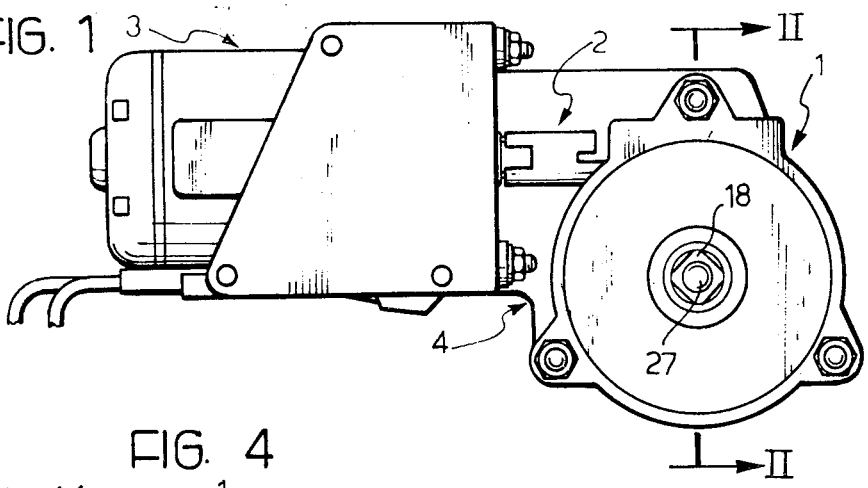
FIG. 1 is a diagrammatic lateral elevational view of an electric window regulator for motor vehicles according to one embodiment of the present invention.

Referring to the drawings, reference numeral 1 indicates generally a window regulator according to the invention including a speed reduction gear which is driven, through a coupling 2, by an electric motor 3. The aforesaid parts are supported by a shaped bracket 4 by which the regulator may be mounted on the door of a vehicle.

Figure 4:
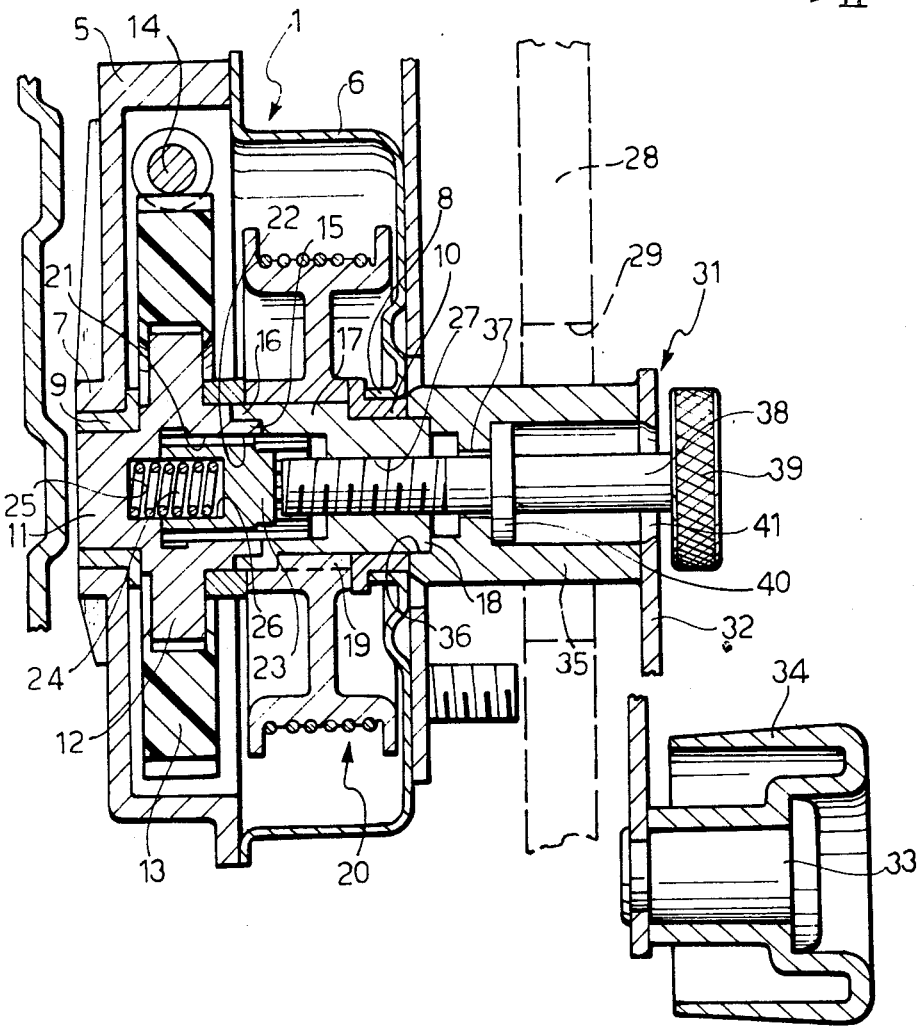
FIG. 4 is an axial section, similar to FIG. 2, showing the window regulator during manual emergency operation.
Figure 2:
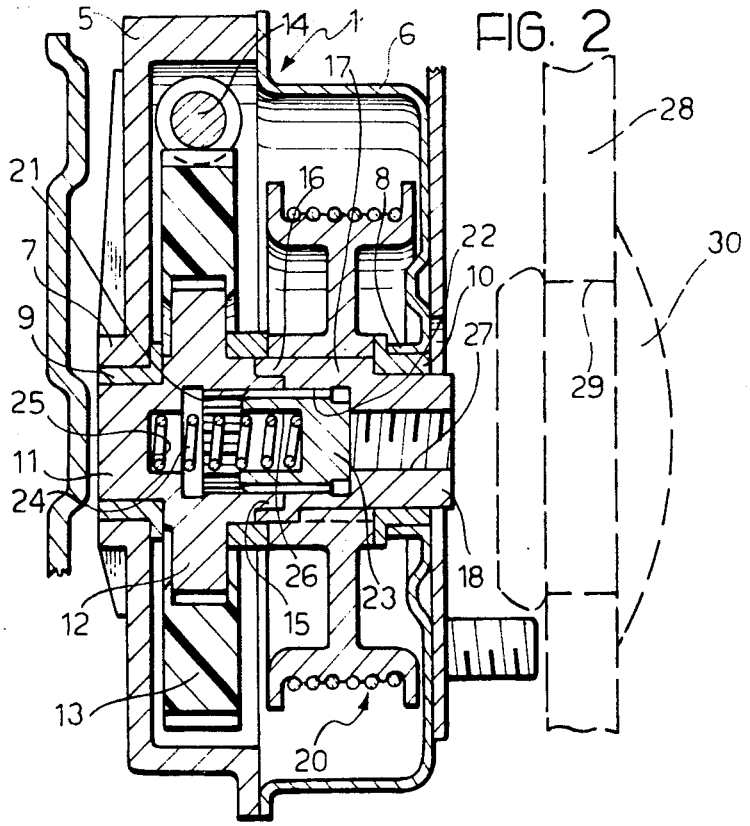
FIG. 2 is an axial cross-section of the window regulator, taken along the line II—II of FIG. 1, and showing the window regulator in its usual operating position.
Figure 3:
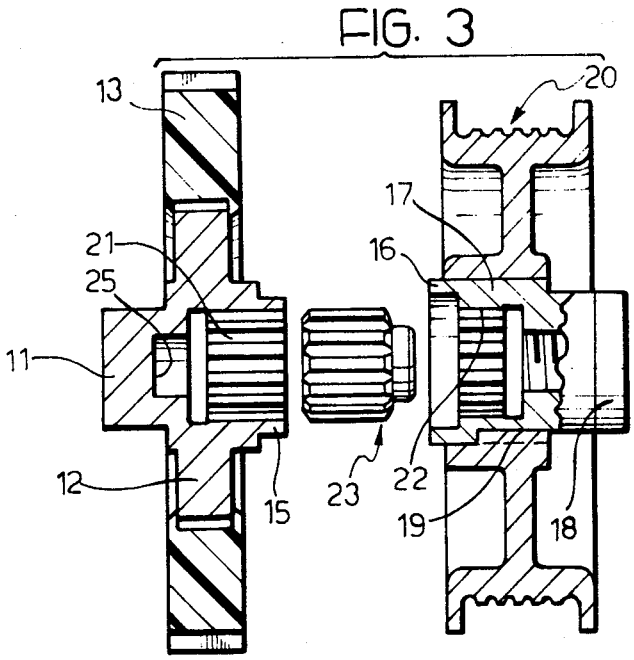
FIG. 3 is an exploded axial section of the window regulator, showing some component parts thereof.

As shown in FIGS. 2 to 4, the window regulator has a casing formed by a hollow cast metal element 5 and a hollow element 6 stamped out of sheet metal, these two elements 5, 6 being hermetically joined together. The two casing elements 5, 6 both have central bosses 7, 8 in which respective bushings 9, 10 are located for supporting the rotating parts of the regulator. The bushing 9 supports a hub 11 which forms part of a metal insert 12 inserted in a helicoidal gear 13 which meshes with a worm screw 14 to form a speed reduction gear. On its face opposite the bushing 9 the metal insert 12 has a cylindrical boss 15 on to the outside of which there fits, coaxially, a collar 16 which forms part of a hollow shaft 17. On to the shaft 17 there is keyed, by means of a part 19 acting as a key, a grooved drum 20 upon which a cable is wound which controls the movement of a vehicle window (not shown). The shaft 17 is supported by the second bushing 10, and it has an outer end portion 18 with a polygonal, preferably square, cross section.

The metal insert 12 of the gear 13 and the shaft 17 fixed to the drum 20 are kinematically joined together, or otherwise coupled, by means of an internal coupling. For this purpose there is provided in the centre of the insert 12 a blind axial cavity 21 having axial splines and a similar splined cavity 22 is formed in the shaft 17 which has, in its terminal portion, a threaded axial bore 27. In the two splined cavities 21, 22 there engages a splined plug 23, loaded by a helical spring 24 housed in a blind cavity 25 in the insert 12 and in an opposed blind cavity 26 in the said plug. The action of the spring 24 is such that it normally keeps the plug 23 in the engaged position, as illustrated in FIG. 2, so that half of its length will be inserted into the cavity 22 of the shaft 17, and the other half in the cavity 21 of the insert 12, thus coupling the shaft 17 and the gear 13 together.

Upon operation of the electric motor 3, the reduction gear 13, 14 transmits rotation to the drum 20 to control the operation of the window in both directions.

The window regulator is concealed from view by a panel 28, shown in broken outline in FIG. 2, forming an interior covering of the door of the motor vehicle: this panel has an aperture 29, coaxial with the same axis of the window regulator drum, the aperture 29 being normally closed by a removable stopper 30.

In the event of a failure of the electric window regulator manual operation of the window can be effected by removing the stopper 30 and inserting an auxiliary handle 31, supplied in the tool kit of the vehicle, into the aperture 29. The handle 31, as shown in FIG. 4, comprises a lever 32 having at its free end a pin 33 upon which a knob 34 is rotatably mounted and at its opposite end a bushing 35. The bushing 35 has an internal polygonal, for example square, cavity 36 which cooperates with the polygonal end portion 18 of the shaft 17 fixed to the drum 20, to form a coupling with the shaft 17. The bushing 35 has an apertured internal radial wall 37 within which there is guided a threaded shank 38 bearing at one end a knurled head 39 and having intermediate its ends a flange 40 which prevents the shank 38 from leaving the bushing by interference with inwardly swaged portions 41 of the handle lever 32.

In order to effect emergency operation of the window the bushing 35 of the auxiliary handle 31 is first applied to the polygonal end portion 18 of the shaft 17, as described above, and the threaded shank 38 is screwed into the threaded bore 27 of the shaft. This causes the threaded shank 38 to thrust the splined plug 23 axially against the action of the spring 24 until it enters the cavity 21 of the gear insert 12, breaking the splined coupling between the gear 13 and the drum 20. The drum 20 can then be rotated directly by the auxiliary handle 31 to effect manually, and with a small number of turns of the said handle, complete movement of the window in either direction as desired.

If, in the above-mentioned emergency conditions, it is desired to lock the window so as to prevent its lowering by its own weight or by manual operation from the outside, it is simply necessary to unscrew the threaded shank 38 until the plug 23 is displaced by the spring 24 to fit even partially into the cavity 22 of the shaft 17: the irreversibility of the coupling between the worm screw 14 and the helical gear wheel 13 then serves to prevent rotation of the drum 20 and keep the window effectively locked in position.

It will be evident that the window regulator according to the invention has a total bulk which differs little from that of electric window regulators not equipped for emergency operation, the regulator being operable manually by an emergency handle with very few turns.

It will be understood that practical embodiments of the invention and details of construction may be widely varied from what has been described and illustrated, without nevertheless departing form the scope of this invention.

What we claim is:

1. An electric window regulator for motor vehicles, comprising a grooved drum upon which is wound a window operating cable, an electric motor drivingly connected to the drum through a reduction gear, the driven member of the reduction gear being disposed alongside the grooved drum, a coupling for connecting the drum torsionally to the said driven member, the said coupling having an axially movable member, loaded by resilient means so as normally to couple the driven member and the drum together, and an auxiliary handle for effecting manual emergency operation of the regulator, said handle being adapted to fit on to an outer end portion of the hub of the drum and having a threaded shank which is adapted to be screwed into the said hub to displace the movable member of the coupling axially until it ceases to couple together the drum and the driven member of the reduction gear, thereby making possible manual operation of the drum by means of the said auxiliary handle.

2. An electric window regulator according to claim 1, in which the coupling between the driven member of the reduction gear and the grooved drum includes a splined plug which is movable axially in two splined cavities, facing each other, formed in the said driven member and the drum respectively, or in respective inserts in the said driven member and the drum.

3. An electric window regulator according to claim 1, in which the drum, or an insert fixed to it, has at one axial end a portion with a polygonal cross section adapted to be engaged by a bushing fixed to the auxiliary handle and having a cavity of complementary cross sectional shape to said end portion.

* * * * *